United States Patent [19]

Lowrie et al.

[11] Patent Number: 4,718,980

[45] Date of Patent: Jan. 12, 1988

[54] INTERSTAGE TREATMENT OF MECHANICAL PULP

[75] Inventors: Leonard E. Lowrie, Rainier, Oreg.; William L. Duncan, Tacoma, Wash.

[73] Assignee: Weyerhaeuser Company, Tacoma, Wash.

[21] Appl. No.: 815,360

[22] Filed: Dec. 30, 1985

[51] Int. Cl.[4] ..... D21C 3/00; D21B 1/16; D21B 1/04

[52] U.S. Cl. ..... 162/78; 162/24; 162/28; 162/26; 162/71

[58] Field of Search ..... 162/24, 28, 78, 25, 162/26

[56] References Cited

U.S. PATENT DOCUMENTS 4,279,694 7/1981 Fritzvold et al. ..... 162/28

FOREIGN PATENT DOCUMENTS 1145107 4/1983 Canada ..... 9/12

OTHER PUBLICATIONS

McDonough, T. J. and Andrews, D. H.; Chemithermomechanical and Chemimechanical Pulps from Hardwood; CPPA Trans. Tech. Sect. 6, (1980), No. 2, TR37.

MacDonald, J. E., "The OPCO Process—The Most Flexible Ultra High Yield Pulping Method" Hymac Ltee Ltd, Jan. 1983.

Leask, R. A. "The OPCO Process" Tech 82, Mechanical Pulping Course.

Heitner, C. et al. "Ultra-High Yield Pulping of Eastern Black Spruce Part III, Interstage Sulfanation" International Mechanical Pulping Conference 1981.

Akerlund et al. "Defibrator Bleaching—A New Concept in TMP; 1979 International Mechanical Pulping Conferance, Jun. 1979; pp. 237-243.

*Primary Examiner*—S. Leon Bashore
*Assistant Examiner*—Thi D. Dang

[57] ABSTRACT

A two-stage pulp refining system in which the fibrous material from the first stage refiner is in contact with an alkaline bleaching solution between refining stages at a temperature of 32°-96° C. and at a consistency of 15-25% on an oven dry basis. The material is then diluted and then pressed to a consistency of at least 20% and passes through the second stage refiner.

5 Claims, 6 Drawing Figures

INTERSTAGE TREATMENT OF MECHANICAL PULP

BACKGROUND OF THE INVENTION

FIG. 1 discloses a typical flow sheet for a two-stage refining process for the manufacture of mechanical pulp. Chips 10 are introduced into a primary refiner 12. In refiner mechanical pulp the chips will be cold when fed to the refiner 12. In thermomechanical pulp the chips will have been presteamed under pressure. The TMP Survey, *Pulp & Paper*, July 1978, pp. 99–110 states that the presteaming may be from 1–8 minutes, the usual being from 2–4 minutes and the pressure may be from 7 to 45 psi, the usual pressure being from 15 to 25 psi. Chemicals may also be added to the chips. The usual chemicals are hydrogen peroxide, sodium bisulfite, sodium sulfite, alum or sodium hydroxide.

The first stage refiner 12 is a pressure refiner. The TMP Survey states that the pressure in the refiner is from 11 to 40 psi. The consistency of the pulp in the first stage is from 23 to 45% and from 41 to 102 horsepower per daily oven dry ton is supplied to the refiner.

The fibers 14 from the first stage refiner 12 pass to a cyclone 18 in which the steam 20 is separated from the fibers. The cyclone 18 may be atmospheric or pressurized. Pressure cyclones allow steam 20 to be collected in an appropriate heat recovery system. The fibers 26 then pass to the second stage refiner 42 in which the fiber bundles are further defibered. The second stage refiner operates at atmospheric pressure. The TMP Survey states that the consistency in a secondary refiner is from 13 to 40% and from 27 to 68 horsepower per daily oven dry ton is supplied to the refiner.

The fibers 44 then pass to a latency tank 46 in which the fibers are soaked in hot water to remove the latency from the fibers. The TMP Survey shows the pulp consistency in the latency tank to be from 1 to 4.5%, the usual consistency being 2–3%. The time in the tank is from 1 to 120 min., the normal being from 20 to 30 min., and the temperature in the tank is from 57° to 96° C., the normal temperature being about 70° C.

The fibers 48 from the latency tank 46 then pass to a screen 52 in which the rejects, the fiber bundles and other reject materials, are separated from the individual fibers. The rejects are processed in a reject refiner system 54. The rejects from the screens 52 are carried to a reject tank 58. The material 60 from the reject tank 58 is carried to a press 62 which raises the consistency of the fiber mass. The pressate 64 is collected in a filtrate chest for reuse. The higher consistency reject material 66 then passes to a reject refiner 68. The TMP article indicates that the consistency of the material in the reject refiner 68 may be anywhere from 3 to 35%. The fibers 70 from the reject refiner 68 pass to a storage tank 72 and the material 74 from the storage tank is returned to the screen 52. A pump 76 aids in the transfer of the material 74 to the screen 52.

The accepted material fibers 78, from the screen 52 pass to further fiber processing 84 in the mill. This can include bleaching and paper or pulp formation. The material may be used for tissue, board, newsprint, magazine, rotogravure and offset grades of paper, cartonboard and speciality papers. The material 86 is transported from the mill.

FIG. 2 discloses a special refining process for refining 100% aspen chips to a powder like material which is used as a filler in paper. The chips 110 enter a first stage refiner 112 in which they are ground into fibers and fiber bundles. The material 114 from the first stage refiner 112 passes to a latency tank 124 in which the fibers and fiber bundles are treated at a consistency of 4% in hot water. The treated material 126, still at 4% consistency, is transported by a pump 128 to the second stage refiner 142 in which the fibers and fiber bundles are further refined at the 4% consistency. The material 144 from the second stage refiner 142 passes to a second latency tank 146 having conditions which are the same as those in the latency tank 46 of FIG. 1. The material 148 from the tank 146 is moved by a pump 150 to the screen 152. The rejects from screen 152 are treated in the reject refining system 54 which is identical to reject refining system 54. Similar reference numerals are used to denote the same equipment and flows. The accepted material 178 from the screen 152 passes to an additional refiner 180 where it is ground to a flour like material. This material 182 is then used as a filler for paper.

FIG. 3 is a diagram of the Sunds "Compacter" process. The chips 210 pass through the primary refiner 212 and the material 214, fibers and fiber bundles, from the refiner 212 passes to a cyclone 218 in which the steam 220 is removed from the material. The material 226 then moves to a press 230. The pressate 232 is sent to a sewer. The higher consistency material 240 from the press 230 then passes through the second stage refiner 242. The material 244 from the refiner passes to a latency tank 246 where it is soaked and the latency removed. The material 248 from the tank 246 is moved by pump 250 to the screen 252. The rejects from the screen 252 are treated in the reject refining system 254 which is identical to reject refining systems 54 and 154. Similar reference numerals are used. The accepted material 278 from the screen 252 passes through additional processes 284 within the plant and the finished material 286 is transported from the plant.

FIG. 4 discloses a one-stage refining process. In this the chips 310 pass through the refiner 312 and the material from the refiner 312 passes through the cyclone 318 in which the steam 320 is removed. The material 322 from the cyclone 318 then passes to the latency tank 346. The material 348 from the latency tank 346 is moved by pump 350 to the screen 352. The reject refining system 354 and the additional processing 384 are the same as those shown and described in FIGS. 1 and 3 and similar reference numerals are used.

The Opco process is described in "The Opco Process: The Most Flexible Ultra High Yield Pulping Method" by J. E. McDonald; "The Opco Process," Mr. R. A. Leask, Tech '82 Mechanical Pulping Course; and "Ultra High Yield Pulping of Eastern Black Spruce, Part 3, Interstage Sulfanation," by C. Heitner, et al. International Mechanical Pulping Conference 1981.

Canadian Pat. No. 1,145,107 describes a treatment of mechanical pulp.

SUMMARY OF THE INVENTION

There are four problems in the manufacture of mechanical pulp. One is the reduced strength of the paper formed from the pulp because of the chopped and abraded fibers. The second is the high electrical demand of the refiners. The third is the brightness of the pulp produced. In thermomechanical pulp there is a fourth concern and this is the high bulk of the fiber produced.

The inventors have worked in mechanical and thermomechanical pulp for many years and have been concerned about these problems. It was decided that some of the problems could be solved if the fibers and fiber bundles were soft and limp when entering the second stage refiner. It was thought that the fiber would require less refining energy and, therefore, refiner power consumption per ton of pulp processed. It was thought that the fiber would be less abraded, less cut and have less bulk.

It was decided to soak the fibrous material from the first refining stage in hot water and then press the soaked material to increase its consistency to above 15% on an oven dry basis and then process the material in the second refining stage. The pressate from the press would be added to the soak tank. The first stage of refining would, as usual, be under pressure and the second stage of refining would be at atmospheric pressure. The water soak would be at atmospheric pressure and a temperature of 65°-75° C. In a mill trial there was an increase in the throughput rate through the second stage refiner with a subsequent overall reduction of electrical refining energy of 10%. There was, however, no statistical property difference between unsoaked (control) and soaked fiber.

They then decided to treat the fiber with alkali and a bleaching chemical between the refining stages. Sodium hydroxide and hydrogen peroxide were used. The treatment is at a consistency of 15-25%. The higher temperatures and soak time as described above were used. The material is then diluted to a consistency below 15%, preferably 3-4%. It is then pressed to a consistency above 20%, preferably above 25%.

This concept was recently tested in a modified line of mainline refiners at a mill. This pilot line enabled full production, 180 ADMT/day (air dry metric tons/day) of pulp, made from the usual mix of mill raw materials. The trials culminated in a 62-hour process trial run in which the material was treated with alkaline peroxide between refiner stages. In these tests, the physical properties increased. At equal pulp Canadian Standard freeness; the burst increased 30%, the breaking length increased 32%, tear increased 17%, porosity decreased 29%, shives decreased 79%, and pulp handsheet bulk decreased 10%. These results were achieved with an average of 23 lbs./ton of hydrogen peroxide and 19 lbs./ton caustic dosed on the pulp. The throughput rate increased and refiner energy decreased as seen in the soaking trials. In addition, the pulp brightness increased 6.5 points.

The system can reduce costs. The present systems use a primary refiner in conjunction with a specific secondary refiner. The use of the peroxide bleach tower and press between the first and second stages would allow a reduction in the total number of secondary refiners or an improved power split, permitting the loading of the second refiner. The fewer number of refiners required will reduce power and capital cost.

BRIEF DESCRIPTION OF THE DRAWINGS

FIG. 1 being a two-stage refining process; FIG. 2 being a three-stage refining; FIG. 3 being a two-stage refining process; and FIG. 4 being a one-stage refining process.

DESCRIPTION OF THE PREFERRED EMBODIMENT

Figure 1:
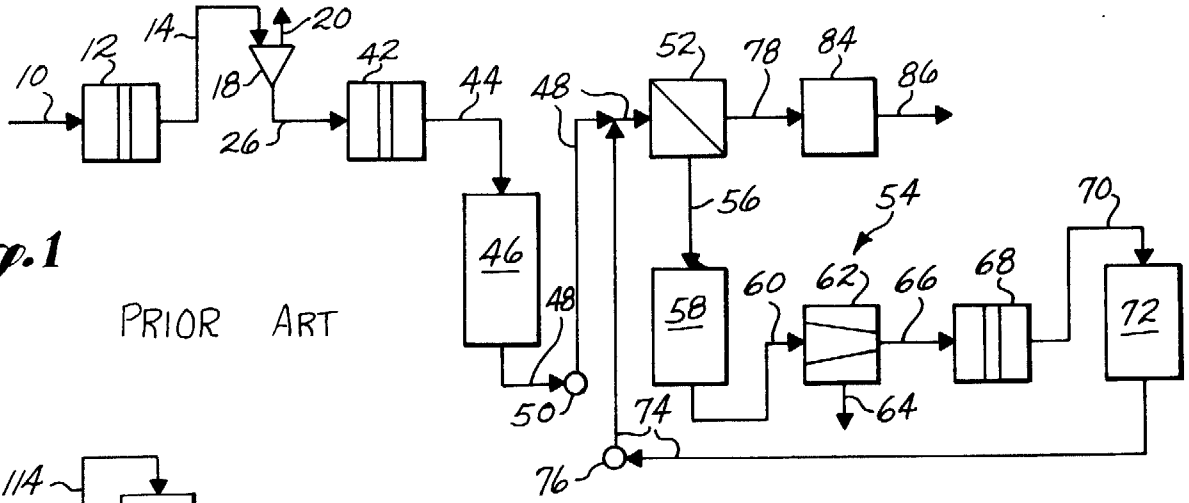
PRIOR ART Fig. 1
FIGS. 1-4 are diagrams of various mechanical refining systems.
Figure 2:
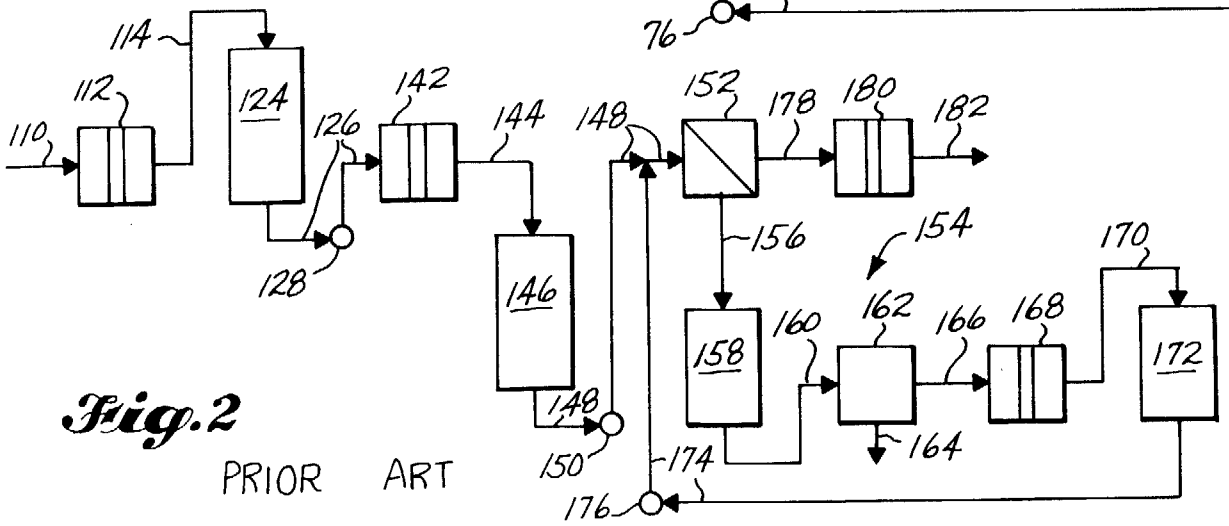
PRIOR ART Fig. 2
Figure 3:
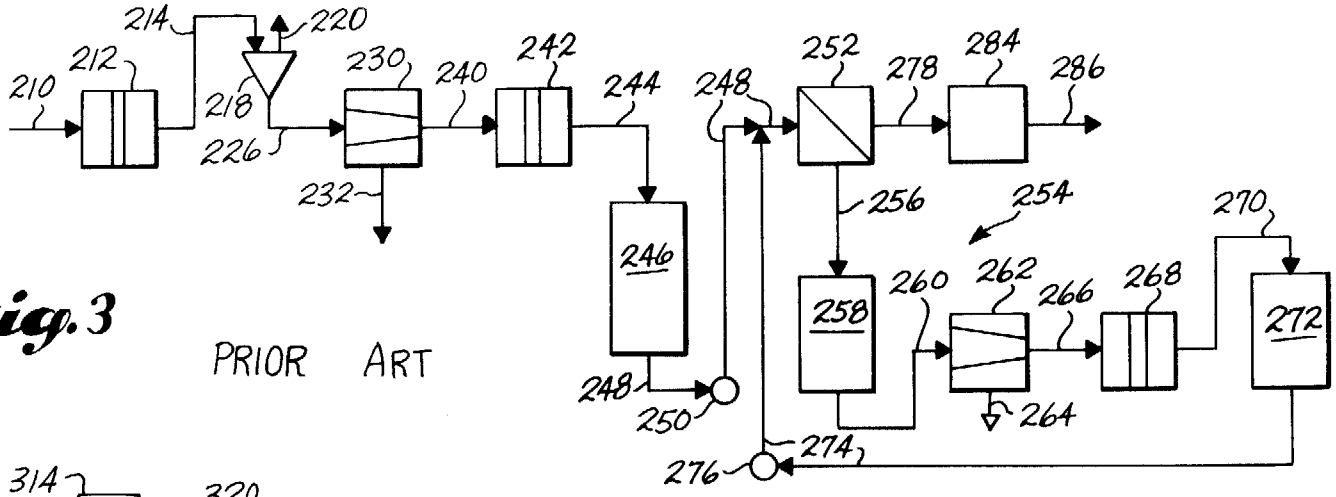
Figure 4:
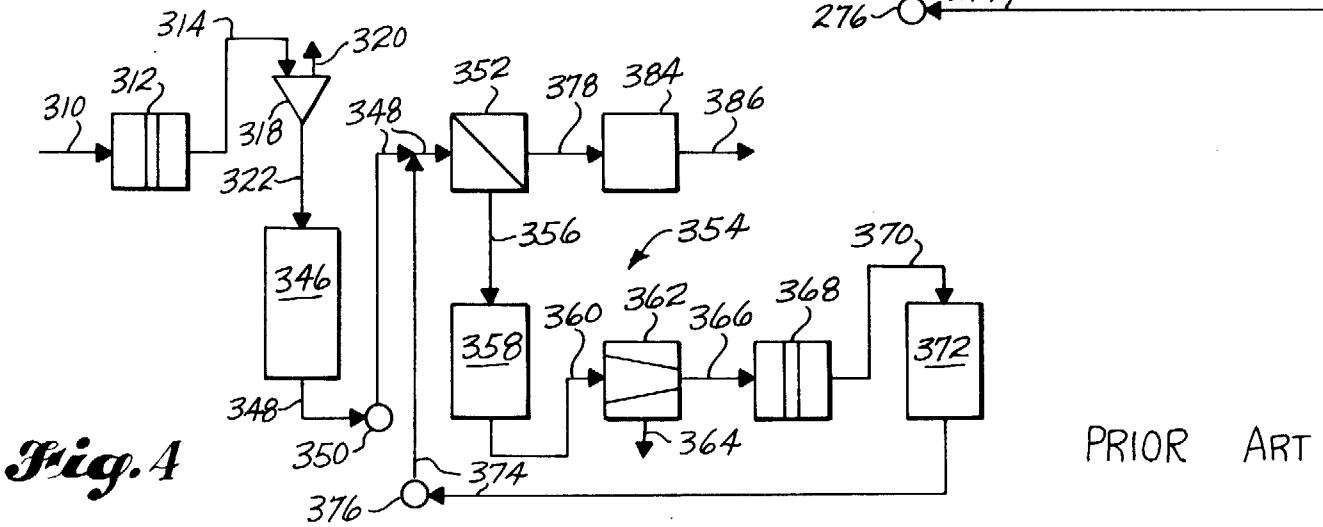
Figure 5X:
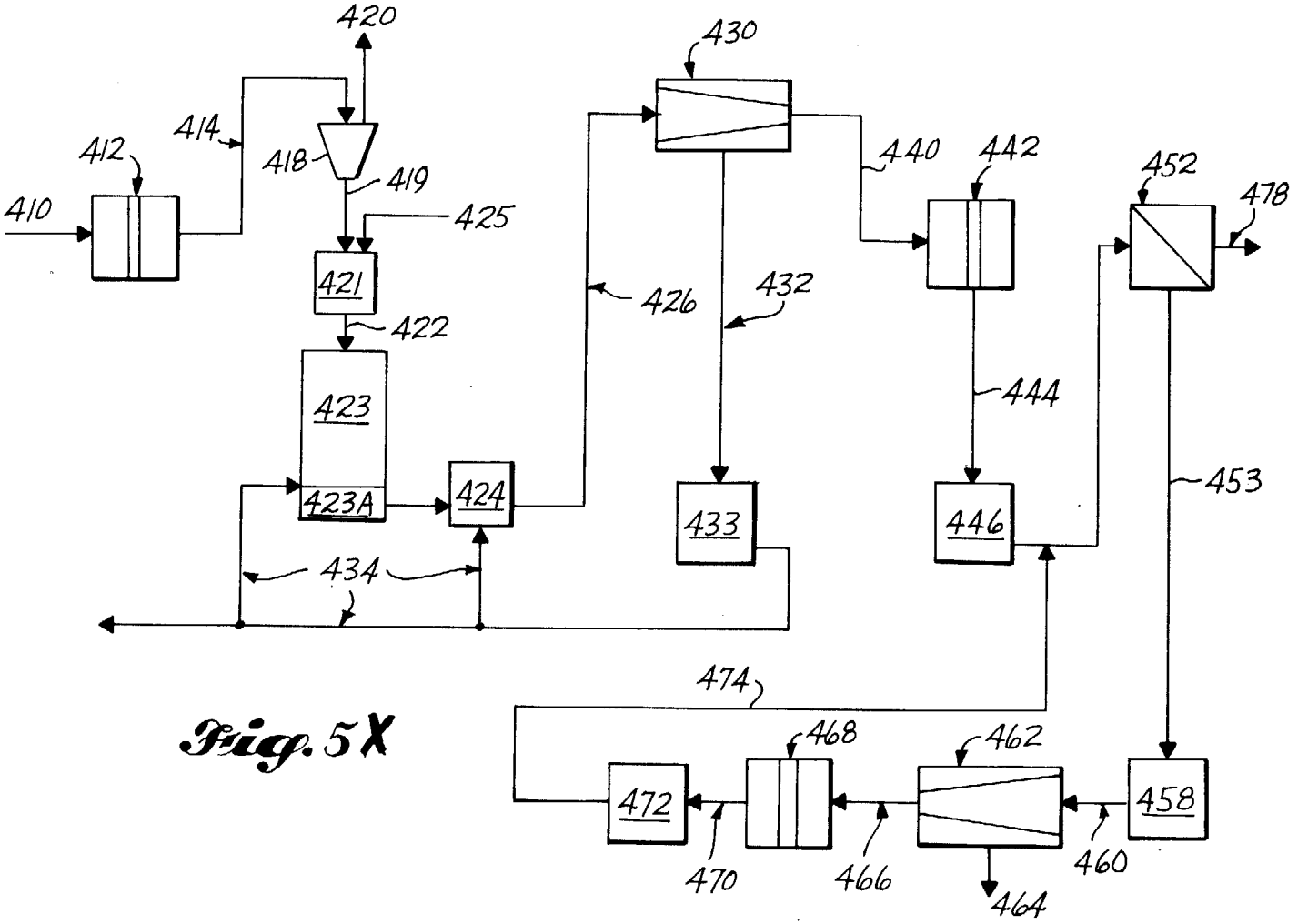
FIG. 5 is a diagram of the present invention.

FIG. 5 is a diagram of the inventive process. Chips 410 enter the primary refiner 412 and the material 414, fibers and fiber bundles, from the refiner goes to an atmospheric or pressurized steam cyclone 418 where steam 420 is separated from the pulp 414. From the atmospheric or pressurized steam cyclones 418 pulp 419 is shown being either conveyed or discharged directly into a single chemical mixer 421, and peroxide bleach chemical and alkali 425 are shown being added to the pulp at the inlet of this mixer. The chemical 425 may be added to the pulp at the base of cyclone 418 and the mixer 421 eliminated. This is not shown. The mixed slurry 422 is discharged directly into a bleach retention tower 423 at a consistency of 15-25% O.D. A sample of the slurry 422 is taken at the inlet of the tower 423 and its brightness measured. The bleach tower 423 would be vented.

Pulp is retained at the consistency of 15-25% in the tower 423 for ½-2 hours at a temperature of 32°-96° C. Bleached pulp is extracted from the bottom of the tower by means of extraction device 423A with minimum in-tower dilution. The extracted, bleached pulp is further diluted in either an agitated tank or in-line mixer 424 to 3.0-4.0% O.D. consistency. Diluted pulp 426 is then pumped and distributed to presses 430 and pressed to 20-25% O.D. consistency. Pressed pulp 440 will discharge directly to the secondary refiner transfer conveyors thence to the secondary refiner 442. Press effluent (pressate) 432 will be collected in an agitated tank 433, cloudy filtrate from the decker filtrate tank (not shown) will be added by the tank 433 level control and the mixture 434 used for dilution in the dilution tank 424 and tower bottom 423A with excess going to the chip washer (not shown).

Pulp consistency and flow rate (gpm) to the presses 426, the flow of dilution water 434 and level in bleach tower 423 can be measured and this information used to compute a continuous material balance with which to set the flow of bleach chemical or alkali at 425. A secondary flow based on brightness sensor reading will adjust bleach chemical flow at 425 according to brightness variations.

The secondary refiner pulp 444 will discharge into the latency chest 446 from there pumped to screens 452 with screen accepts 478 going into the existing mill scheme as described in FIG. I. The rejects 453 from screens 452 will discharge to the rejects refining system 454. The conditions in and elements of latency tank 446, screen 452 and the rejects refining system 454 are the same as those described in FIG. I.

Figure 6:
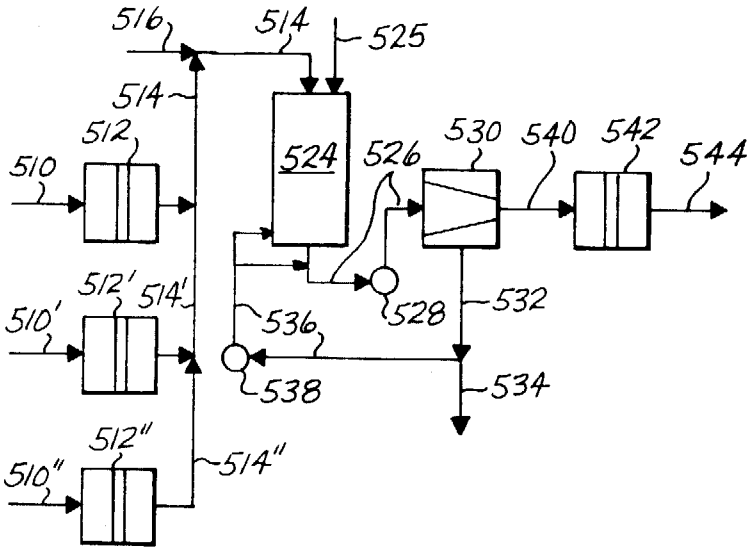
FIG. 6 is a diagram of the present invention showing the use of multiple primary refiners with fewer secondary refiners.

FIG. 6 shows the modification of the process in which several primary refiners 512 supply material, fibers and fiber bundles, to the tank 524. The tank in turn supplies fiber to presses 530 and a smaller number of secondary refiners 542. The process, otherwise, is as described in FIG. 5, and like reference numerals are used.

EXAMPLE

Interstage peroxide treatment was tried on a mill scale. Fiber from an existing primary state refiner was diverted from the existing atmospheric steam cyclone separator to an existing down stream peroxide bleach tower. A vent was installed in the top of the tower to separate the steam from the fiber. Hydrogen peroxide bleach solution was added directly into this "blow" line from the primary refiner. It was assumed that the turbulence in this line would give good enough mixing for trial purposes. The tower gave a residence time of approximately 1 hour at a pulp consistency of 17% O.D. and tower level of 50%. The bleached pulp was then diluted with standard mill process water to a 3.5–4.0% O.D. consistency and pumped via existing pumps to a newly installed pulp press. Two presses were used in parallel to get enough capacity for the 180+ ADMT/-day production rate that was obtained under trial conditions.

Based on prior laboratory tests a nominal dosage rate of 23 lbs./ton hydrogen peroxide (100% basis) on pulp was targeted, with a 0.8:1 caustic to peroxide ratio or 19 lbs./ton NaOH (100% basis). The initial bleach liquor pH was 11.5–12.5 pH and after dilution with standard mill process water of pH 4.5, the resultant dilute pulp pH was 5.8. At this pH, there was no residual caustic but the tower discharge did contain from 4–10 lbs./ton residual hydrogen peroxide. This residual was sent along with the fiber via pressing to the existing secondary refiner. In addition to hydrogen peroxide ($H_2O_2$) and sodium hydroxide (NaOH), a buffering agent sodium silicate (NaSi) and chelating agent DTPA were added in the amount of 40 lbs./ton and 7 lbs./ton, respectively. This sodium silicate added alkalinity as well as serving to prevent premature decomposition of the hydrogen peroxide. The pulp chips were chelated with DTPA at 7 lbs./ton at the digester ahead of the primary refiner.

The operation of the pilot line and the conditions of the trial were carried out by mill operating personnel on a regular mix of raw materials. All other conditions such as age and condition of refiner plates, refiner operation water flow, and chemistry were all kept as is usual for standard mill conditions. This served to keep the comparison of our standard (base line) pulp and the peroxide interstage treated pulp on an equal and compatible basis. In addition, parallel lines of refiners run in the conventional operating mode were tested to show that there was not a change in the raw material being fed to the test which would bias the comparison.

The trial was run with peroxide (test) and without peroxide (control) for 62 hours. Pulp was sampled every half hour and composited into two-hour samples containing four discrete samples. This was done to smooth out local micro variations typically found in refining. The control was sampled in the same way. The target for the two sample sets was 130 mls Canadian Standard Freeness. Again, the two pulps must be compared on an equal basis. Canadian Standard freeness was chosen as the basis because it is industry standard practice and the 130 mls level was chosen because this is typical of standard production to reach acceptable newsprint quality levels. Table I is the complete data set for the control and Table II is the complete data set for the test. Table III is a compilation of the averages of the interstage peroxide treated pulp and of the standard control pulp.

In the Tables, ISP is Interstage Peroxide treatment; CSF is Canadian Standard Freeness in mls; Shive is the percent shives; +28 is the fibers remaining on a 28 mesh screen; −200 is the percent of fibers passing through a 200 mesh screen; Bright is pulp brightness expressed in %, 100% being a $CaCO_3$ bleach standardized by the Institute of Paper Chemistry; Bulk is the pulp mat bulk expressed in $cm^3/g$; Burst is the pulp mat burst factor expressed in psi; Brk Len is the breaking length expressed in km; Tear F is the tear factor expressed in $m/sec^2$; Str F is the strength factor, an empirical sum of the burst factor, tear factor and breaking length which has no units; and Poro is the Porosity expressed in mls air leaked/sec.

TABLE I

Interstage Peroxide - Trial Data
(Test Properties of Two-Hour Composits from Secondary Refiner)
CONTROL

| Sample | ISP | CSF | Shive | +28 | −200 | Bright | Bulk | Burst | Brk Len | Tear F | Str F | Poro. |
|---|---|---|---|---|---|---|---|---|---|---|---|---|
| 5291300 | no | 188 | 0.83 | 24.06 | 33.96 | 50.00 | 3.49 | 14.94 | 2.63 | 81.2 | 98.77 | 400 |
| 5291600 | no | 169 | 0.87 | 25.90 | 34.50 | 53.07 | 3.69 | 13.35 | 2.58 | 64.3 | 80.23 | 371 |
| 5291800 | no | 133 | 0.57 | 22.12 | 36.28 | 51.72 | 3.54 | 14.94 | 2.94 | 67.4 | 85.29 | 235 |
| 5291930 | no | 151 | 1.13 | 21.64 | 36.50 | 50.99 | 3.49 | 13.90 | 2.55 | 64.4 | 80.85 | 275 |
| 5292130 | no | 114 | 0.57 | 19.40 | 37.88 | 51.20 | 3.15 | 16.90 | 3.21 | 64.0 | 84.13 | 164 |
| 5292330 | no | 108 | 0.48 | 19.06 | 39.36 | 50.06 | 3.24 | 16.41 | 3.12 | 86.6 | 86.1 | 151 |
| 5290130 | no | 129 | 0.50 | 21.62 | 33.74 | 49.46 | 3.34 | 15.26 | 2.93 | 64.4 | 82.58 | 214 |
| 5290330 | no | 135 | 0.70 | 21.42 | 30.88 | 49.59 | 3.34 | 15.43 | 2.69 | 63.2 | 81.31 | 235 |
| 5290530 | no | 132 | 0.82 | 20.00 | 36.96 | 52.11 | 3.43 | 15.65 | 2.85 | 79.0 | 97.5 | 262 |
| 5300730 | no | 136 | 1.02 | 21.18 | 34.68 | 51.69 | 3.33 | 16.89 | 2.83 | 55.1 | 84.82 | 266 |
| 5300900 | no | 136 | 0.81 | 20.70 | 37.50 | 52.81 | 3.30 | 15.89 | 3.00 | 83.8 | 102.48 | 282 |
| 5301100 | no | 148 | 0.70 | 19.64 | 38.36 | 52.96 | 3.07 | 14.99 | 2.81 | 76.2 | 93.96 | 290 |
| 5301300 | no | 143 | 1.32 | 20.70 | 35.88 | 52.87 | 3.46 | 13.97 | 2.37 | 65.2 | 81.54 | 296 |
| 5301800 | no | 155 | 0.87 | 21.62 | 34.36 | 49.45 | 3.32 | 15.08 | 2.86 | 64.1 | 82.04 | 254 |
| 5301930 | no | 122 | 0.76 | 16.60 | 38.06 | 48.82 | 3.26 | 16.48 | 2.93 | 69.4 | 77.80 | 193 |
| 5302130 | no | 133 | 1.00 | 17.58 | 35.74 | 50.78 | 3.38 | 15.34 | 2.33 | 62.4 | 80.11 | 242 |
| 5302330 | no | 118 | 0.67 | 17.56 | 35.28 | 52.28 | 3.26 | 15.81 | 2.95 | 58.3 | 77.08 | 190 |
| 5300230 | no | 108 | 0.52 | 16.62 | 35.40 | 48.35 | 3.22 | 16.04 | 2.85 | 58.6 | 77.57 | 176 |
| 5300330 | no | 130 | 0.70 | 16.76 | 38.42 | 50.10 | 3.44 | 13.8 | 2.77 | 56.9 | 72.47 | 257 |
| 52942.1 | no | 153 | 0.69 | 12.54 | 35.44 | 51.72 | 3.54 | 11.46 | 2.35 | 56.44 | 70.25 | 388 |
| 52942.2 | no | 133 | 0.62 | 16.38 | 25.4 | 52.20 | 3.36 | 13.25 | 2.74 | 51.14 | 67.13 | 284 |
| 53042.3 | no | 121 | 0.46 | 13.14 | 33.98 | 48.33 | 3.37 | 14.11 | 2.82 | 52.97 | 89.90 | 227 |

TABLE II

Interstage Peroxide - Trial Data
(Test Properties of Two-Hour Composite from Secondary Refiner)
Interstage Peroxide - Treated

| Sample | ISP | CSF | Cons. | Shive | +28 | −200 | Bright | Bulk | Burst | Brk Len | Tear F | Str F | Poro |
|---|---|---|---|---|---|---|---|---|---|---|---|---|---|
| 5311900 | yes | 116 | 15.00 | 0.18 | 23.44 | 31.72 | 52.80 | 2.86 | 22.10 | 4.27 | 75.40 | 102 | 121 |
| 5312130 | yes | 108 | 18.50 | 0.12 | 23.28 | 30.18 | 49.30 | 2.87 | 22.16 | 4.29 | 77.33 | 104 | 119 |
| 5312330 | yes | 114 | 19.10 | 0.06 | 19.30 | 30.24 | 52.50 | 2.86 | 19.93 | 3.99 | 70.30 | 94 | 137 |
| 5310130 | yes | 100 | 18.30 | 0.08 | 15.10 | 29.70 | 51.90 | 2.72 | 19.80 | 3.93 | 67.00 | 91 | 116 |
| 5310100 | 'C'—CH | 91 | | 0.13 | 20.10 | 34.80 | 54.40 | 2.90 | 21.00 | 3.97 | 71.50 | 99 | 127 |
| 5310330 | yes | 105 | 22.60 | 0.18 | 21.60 | 31.20 | 49.50 | 2.90 | 21.70 | 4.09 | 68.40 | 94 | 114 |
| 5310530 | yes | 98 | 21.40 | 0.14 | 18.20 | 35.00 | 47.00 | 2.93 | 21.30 | 3.99 | 75.00 | 100 | 103 |
| 6010700 | yes | 78 | 17.20 | 0.28 | 24.40 | 23.10 | 50.80 | 2.86 | 21.90 | 3.81 | 82.60 | 108 | 95 |
| 6010900 | yes | 112 | 18.30 | 0.18 | 20.20 | 34.20 | 52.50 | 2.95 | 20.20 | 3.75 | 85.40 | 109 | 136 |
| 6011100 | yes | 125 | 17.80 | 0.14 | 19.50 | 32.20 | 52.70 | 2.99 | 20.30 | 3.84 | 84.90 | 109 | 153 |
| 6011300 | yes | 169 | 20.80 | 0.26 | 27.90 | 29.10 | 51.10 | 3.11 | 19.10 | 3.52 | 93.70 | 116 | 276 |
| 6011500 | yes | 175 | 21.60 | 0.3 | 26.40 | 31.80 | 53.80 | 3.18 | 18.50 | 3.4 | 75.40 | 98 | 252 |
| 6011730 | yes | 159 | 20.50 | 0.23 | 25.60 | 29.70 | 54.00 | 3.04 | 18.00 | 3.49 | 76.70 | 98 | 237 |
| 6011930 | yes | 141 | 19.60 | 0.19 | 24.70 | 24.40 | 52.20 | 2.91 | 20.00 | 3.71 | 75.00 | 99 | 165 |
| 6012130 | yes | 111 | 15.80 | 0.09 | 13.50 | 34.40 | 49.60 | 2.88 | 19.50 | 3.68 | 60.60 | 84 | 127 |
| 6012330 | yes | 116 | 19.30 | 0.13 | 21.50 | 28.50 | 49.50 | 2.86 | 21.80 | 3.93 | 70.50 | 85 | 157 |
| 6010130 | yes | 126 | 19.20 | 0.11 | 22.80 | 28.70 | 50.70 | 2.92 | 20.10 | 3.8 | 72.50 | 96 | 148 |
| 6010330 | yes | 119 | 19.60 | 0.11 | 22.70 | 32.60 | 49.70 | 2.93 | 20.50 | 3.87 | 75.70 | 100 | 139 |
| 6010530 | yes | 176 | 15.60 | 0.22 | 27.50 | 27.50 | 44.80 | 3.06 | 19.10 | 3.52 | 84.30 | 107 | 208 |
| 6020700 | yes | 108 | 17.00 | 0.09 | 20.40 | 33.90 | 50.70 | 2.94 | 21.20 | 4.09 | 77.80 | 103 | 138 |
| 6020900 | yes | 139 | 19.30 | 0.12 | 22.70 | 31.50 | 50.20 | 2.98 | 20.50 | 3.84 | 79.80 | 104 | 140 |
| 6021100 | yes | 224 | 17.60 | 0.18 | 30.70 | 21.10 | 49.20 | 3.34 | 17.90 | 3.24 | 91.30 | 112 | 378 |
| 6021300 | yes | 221 | 20.50 | 0.39 | 31.60 | 26.60 | 52.60 | 3.40 | 15.40 | 3.31 | 95.80 | 105 | 380 |
| 6021500 | yes | 190 | 18.50 | 0.14 | 15.40 | 40.90 | 51.30 | 3.31 | 18.10 | 3.36 | 79.80 | 101 | 290 |
| 6021730 | yes | 160 | 18.40 | 0.18 | 26.60 | 29.20 | 51.90 | 3.12 | 18.40 | 3.58 | 90.50 | 102 | 210 |
| 6021930 | yes | 138 | 16.90 | 0.08 | 23.00 | 28.70 | 53.00 | 3.04 | 19.10 | 3.7 | 75.60 | 98 | 171 |
| 6022130 | yes | 123 | 17.90 | 0.1 | 21.50 | 28.70 | 52.80 | 2.93 | 20.40 | 3.57 | 77.70 | 102 | 141 |
| 6022330 | yes | 116 | 18.20 | 0.12 | 20.50 | 31.60 | 51.60 | 2.87 | 20.30 | 3.72 | 72.30 | 98 | 135 |
| 6020130 | yes | 114 | 19.00 | 0.08 | 20.60 | 30.40 | 53.00 | 2.89 | 19.90 | 3.49 | 75.40 | 99 | 139 |
| 6020330 | yes | 169 | 19.90 | 0.18 | 26.90 | 27.00 | 50.00 | 3.14 | 19.20 | 3.31 | 80.80 | 103 | 222 |
| 6020530 | yes | 122 | 16.70 | 0.08 | 15.90 | 31.60 | 52.50 | 2.88 | 19.60 | 3.63 | 80.10 | 103 | 140 |

TABLE III

Interstage Peroxide Trial - Summary
(Average Properties After Second Stage Refining)

| Description | Control X | Control J | Trial X | Trial J | % Change |
|---|---|---|---|---|---|
| CSF, mls | 135 | 19.7 | 133 | 35 | — |
| Cons., % O.D. | 15.2 | 2.7 | 18.7 | 1.7 | 23 |
| Shives, % | 0.76 | 0.23 | 0.16 | 0.07 | −79 |
| Bulk | 3.34 | 0.16 | 2.99 | 0.15 | −10.5 |
| Burst factor | 15.3 | 0.95 | 19.9 | 1.5 | 30 |
| Breaking length | 2.82 | 0.23 | 3.73 | 0.27 | 32 |
| Tear factor | 66.4 | 7.4 | 77.4 | 6.8 | 17 |
| Porosity | 245 | 63.4 | 175 | 72.8 | −29 |

X = numerical average
J = standard deviation

We claim:

1. A process for improving the physical properties of two-stage refiner pulp consisting essentially of refining wood chips in a first stage of refining to form fibers and fiber bundles, soaking said fibers and fiber bundles in an alkaline peroxide bleach at a temperature of 32°-96° C., at a consistency in the range of 15-25% for from 30-120 minutes, decreasing the consistency of said fibers and fiber bundles to below 15%, increasing the consistency of said fibers and fiber bundles to a consistency of at least 20%, refining said latter fibers and fiber bundles in a second stage of refining.

2. The process of claim 1 in which said first stage of refining is under pressure.

3. The process of claim 1 in which said first stage is heated by steam.

4. The process of claim 1 in which said consistency is decreased to 3-6%.

5. The process of claim 1 in which said consistency is increased to at least 25%.

* * * * *

UNITED STATES PATENT AND TRADEMARK OFFICE

CERTIFICATE OF CORRECTION

PATENT NO. : 4,718,980

DATED : Jan. 12, 1988

INVENTOR(S) : Lowrie et al.

It is certified that error appears in the above-identified patent and that said Letters Patent is hereby corrected as shown below:

On the cover page (73) Assignee: "Weyerhaeuser Company, Tacoma, Wash." should read --North Pacific Paper Corporation, Longview, Wash. --.

Signed and Sealed this

Twenty-sixth Day of July, 1988

*Attest:*

DONALD J. QUIGG

*Attesting Officer*

*Commissioner of Patents and Trademarks*